US012662931B2

(12) United States Patent
Stark et al.

(10) Patent No.: US 12,662,931 B2
(45) Date of Patent: Jun. 23, 2026

(54) PORTABLE SYSTEM FOR MONITORING AND CONTROLLING SURFACE EQUIPMENT

(71) Applicant: Halliburton Energy Services, Inc., Houston, TX (US)

(72) Inventors: Daniel Joshua Stark, Carrollton, TX (US); Adan H. Herrera, Carrollton, TX (US); Adam Harold Martin, Carrollton, TX (US); Alexander Simon Chretien, Houston, TX (US); Dale E. Jamison, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 604 days.

(21) Appl. No.: 18/082,112

(22) Filed: Dec. 15, 2022

(65) Prior Publication Data

US 2024/0200441 A1 Jun. 20, 2024

(51) Int. Cl.
*E21B 47/12* (2012.01)
*E21B 49/00* (2006.01)

(52) U.S. Cl.
CPC ..... *E21B 47/12* (2013.01); *E21B 49/003* (2013.01)

(58) Field of Classification Search
CPC ..... E21B 47/12; E21B 49/003
See application file for complete search history.

(56) References Cited

U.S. PATENT DOCUMENTS

| | | | |
|---|---|---|---|
| 5,349,644 | A | 9/1994 | Massey et al. |
| 2002/0153419 | A1 | 10/2002 | Hall |
| 2003/0040814 | A1 | 2/2003 | Moebius et al. |
| 2017/0152728 | A1 | 6/2017 | Abou-Sayed et al. |
| 2017/0183967 | A1 | 6/2017 | Masse et al. |
| 2017/0192414 | A1* | 7/2017 | Mukkamala ..... H04L 63/18 |
| 2021/0246780 | A1 | 8/2021 | Munir et al. |

FOREIGN PATENT DOCUMENTS

| | | |
|---|---|---|
| CN | 110206539 | 9/2019 |
| EP | 1635032 | 3/2006 |
| EP | 3143254 | 9/2019 |

OTHER PUBLICATIONS

"PCT Application No. PCT/US2022/081892, International Search Report and Written Opinion", Aug. 31, 2023, 11 pages.

* cited by examiner

*Primary Examiner* — Gary Collins
(74) *Attorney, Agent, or Firm* — DeLizio, Peacock, Lewin & Guerra LLP

(57) ABSTRACT

A monitoring and control system for surface equipment used in industrial services is disclosed. The monitoring and control system may include one or more sensors configured to collect sensor data from the surface equipment, and one or more control devices configured to control one or more operations of the surface equipment. The monitoring and control system may include a data acquisition and control apparatus coupled with the one or more sensors and the one or more control devices. The data acquisition and control apparatus may be configured to receive the sensor data from the one or more sensors and transmit control information to the one or more control devices.

21 Claims, 8 Drawing Sheets

PORTABLE SYSTEM FOR MONITORING AND CONTROLLING SURFACE EQUIPMENT

TECHNICAL FIELD

The present invention relates generally to industrial services, and more specifically to a system for monitoring and controlling surface equipment used in industrial services.

BACKGROUND

Industrial services, such as the oil services industry, may use various types of surface equipment in the field (such as temporary field sites) and in permanent sites, such as refineries, factories, and other types of industrial sites. The surface equipment may be various types of surface equipment, such as surge tanks, transfer pumps, separators, multiphase flow meters, steam heat exchangers, air compressors, choke manifolds, chemical injection pumps, solids collection systems, sand management systems, power generation systems, power distribution systems, pump trucks, water tanks, construction equipment, farm equipment, coiled tubing units, wireline or slickline units, drilling units, hydraulic workovers, mining equipment, transport ships and dock units, chemical processing units, and distribution centers, among others. Legacy surface equipment typically does not include digital sensors that can be used for monitoring, analysis, and control of the surface equipment. Legacy surface equipment is typically monitored, analyzed, and controlled manually and without any type of digitization and automation.

DESCRIPTION

The description that follows includes example systems, methods, techniques, and program flows that describe aspects of the disclosure. However, it is understood that this disclosure may be practiced without these specific details. For instance, this disclosure refers to reservoir modeling in illustrative examples. Aspects of this disclosure can be instead applied to other types of models involving spatiotemporal datasets. In other instances, well-known instruction instances, protocols, structures, and techniques have not been shown in detail to avoid confusion.

Example Systems

Figure 1:
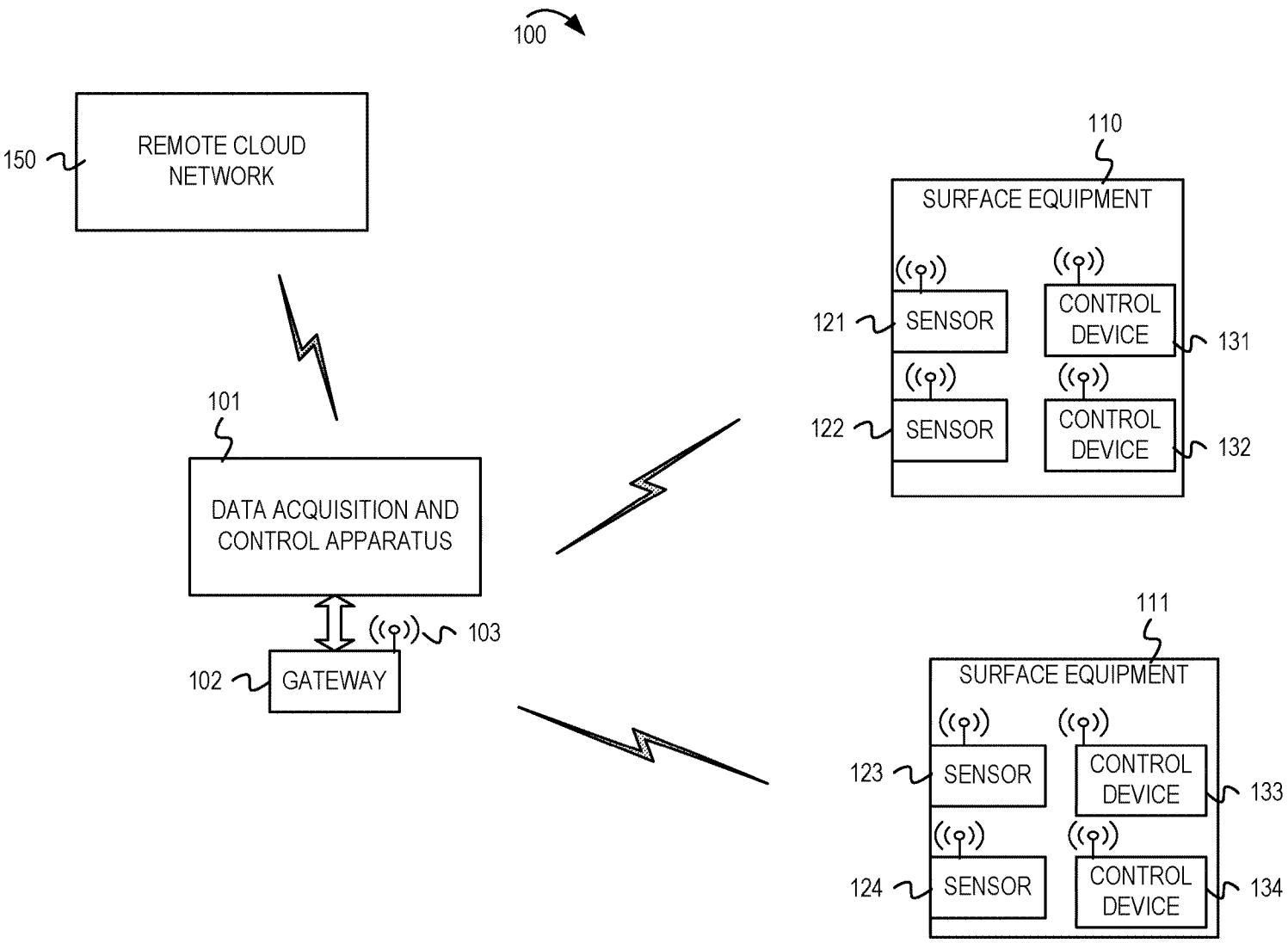
FIG. 1 depicts an example system configured to monitor and control surface equipment.

FIG. 1 depicts an example system 100 configured to monitor and control surface equipment. In some implementations, the system 100 may be configured to monitor and control surface equipment used in industrial services, such as the oil services industry. In some implementations, the system 100 may include a data acquisition and control apparatus 101, one or more sensors, and one or more control devices. For example, the system 100 may include the data acquisition and control apparatus 101, sensors 121-124, and control devices 131-134. The data acquisition and control apparatus 101 also may include a gateway 102 and an antenna 103 for receiving sensor data from the sensors 121-124 and for transmitting control information to the control devices 131-134. The data acquisition and control apparatus 101 may be portable and movable from one location to another. The one or more sensors may be temporarily or permanently installed in new or legacy surface equipment to collect sensor data from the surface equipment. New surface equipment may refer to modern or newly manufactured surface equipment that can be remotely monitored and controlled with the system 100. Legacy surface equipment may refer to older equipment, equipment that has no sensors pre-installed, pre-owned or purchased equipment, and individual pieces of equipment, among others, that can be remotely monitored and controlled with the system 100. The one or more control devices may be temporarily or permanently installed in new or legacy surface equipment to control at least some of the operation of the surface equipment. For example, the sensor 121, the sensor 122, the control device 131, and the control device 132 may be installed in the surface equipment 110, and the sensor 123, the sensor 124, the control device 133, and the control device 134 may be installed in the surface equipment 111.

In some implementations, the one or more sensors (such as the sensors 121-124) may be non-invasive or minimally invasive sensors. In some implementations, the one or more sensors may be configurable to be installed in new or legacy surface equipment used in industrial services, such as the oil services industry or other industrial processes. In some implementations, the one or more sensors may be various types of sensors, such as position sensors, pressure sensors, temperature sensors, humidity sensors, chemical composition sensors, accelerometers, vibrometers, velocimeters, magnetometers, wind velocity sensors, acoustic sensors, GPS sensors, and microphones, among others. In some implementations, the one or more control devices (such as the control devices 131-134) may be non-invasive or minimally invasive control devices. In some implementations, the one or more control devices may be configurable to be installed in new or legacy surface equipment used in industrial services, such as the oil services industry. In some implementations, the one or more control devices may be various types of control devices, such as various types of actuators and other devices that can control some of the operation of surface equipment. For example, various types of actuators may be used to control valves, engine revolutions per minute (RPM), fuel injection rates, voltages, currents, temperatures, and frequencies, among others. In some implementations, the data acquisition and control apparatus 101 may be any type of computer system, such as a laptop computer, desktop computer, tablet computer, or any other types of computers, portable computing devices, or industrial computer equipment. In some implementations, the data acquisition and control apparatus 101 may form an EDGE system for industrial services, such as the oil services industry. In some implementations, the sensors and control devices may be Internet of Things (IOT) devices. In some implementations, the surface equipment may be various types of new or legacy surface equipment, such as surge tanks, transfer pumps, separators, multi-phase flow meters, steam heat exchangers, air compressors, choke manifolds, chemical injection pumps, solids collection systems, sand management systems, power generation systems, power distribution systems, mud pumps, pump trucks, blenders, water tanks, construction equipment, farm equipment, coiled tubing units, wireline or slickline units, drilling units, hydraulic workovers, mining equipment, transport ships and dock units, chemical processing units, and distribution centers, among others. The surface equipment may be temporarily located at a field site or may be permanently located at a factory, refinery or other permanent location.

In some implementations, the data acquisition and control apparatus 101 may receive the sensor data from the one or more sensors and transmit control information to the one or more control devices. For example, the data acquisition and control apparatus 101 may receive sensor data from the sensors 121 and 122 of surface equipment 110 and may receive sensor data from the sensors 123 and 124 of surface equipment 111. As one example, the surface equipment 110 may be a transfer pump and a sensor (such as sensor 121) may measure pressure, and the surface equipment 111 may be a choke and a sensor (such as sensor 123) may measure flow rate or temperature. The data acquisition and control apparatus 101 may transmit control information to the control devices 131 and 132 of surface equipment 110 and may transmit control information to the control devices 133 and 134 of surface equipment 111. As one example, the surface equipment 110 may be a transfer pump and a control device (such as control device 131) may be an actuator or motor that turns a valve of the transfer pump, and the surface equipment 111 may be a choke and a control device (such as control device 133) may be an actuator or motor that turns a valve (or an actuator that turns on or off a switch or button or chooses some intermediate setting) to control the flow through the choke. In some implementations, the data acquisition and control apparatus 101 may receive the sensor data and determine the control information to control the operation of the surface equipment (such as the surface equipment 110 and 111) based on the sensor data. Thus, the system 100 may operate as a highly configurable bridge between the monitoring operations and the control operations. In some implementations, the data acquisition and control apparatus 101 may be configured to digitize and analyze the sensor data for improved monitoring, operation, and control of the surface equipment. The data acquisition and control apparatus 101 may digitize and analyze the sensor data to perform analytics, modeling, and visualization of the collected sensor data. In some implementations, the system 100 may enable various types of services, such as digitization and analytics as a service. The data acquisition and control apparatus 101 also may digitize and analyze the sensor data for automation of the surface equipment.

In some implementations, the data acquisition and control apparatus 101 may receive sensor data from the sensors (such as sensors 121-124) of the surface equipment (such as the surface equipment 110 and 111) and may transmit the sensor data to a remote cloud network 150 for remote processing and analysis of the sensor data. The remote cloud network 150 may be one or more remote servers or other computer systems that may be used to remotely store and analyze the sensor data. In some implementations, the remote cloud network 150 may be configured to monitor and analyze the sensor data and perform analytics, modeling, and visualization of the sensor data for improved monitoring, operation, and control of the surface equipment. The remote cloud network 150 also may work in conjunction with the data acquisition and control apparatus 101 to automate the surface equipment and to send updates, troubleshooting information, and new configurations to the surface equipment. For example, the remote cloud network 150 may determine, maintain, and track various information derived from the received sensor data, such as the time used, measurement errors, and faults. The remote cloud network 150 may use analytics to reconfigure control parameters and error handling routines for the system 100, and may determine maintenance or optimization recommendations and maintain maintenance and optimization records. In some implementations, the remote cloud network 150 may send the derived information to the data acquisition and control apparatus 101 or the data acquisition and control apparatus 101 may download the information from the remote cloud network 150. In some implementations, the remote cloud network 150 may receive the sensor data from the data acquisition and control apparatus 101 and determine the control information for the surface equipment. The remote cloud network 150 may transmit the control information to the data acquisition and control apparatus 101, which then may provide the control information to the surface equipment to control the operation of the surface equipment. In some implementations, the remote cloud network 150 may be used to remotely send updates and configurations to the data acquisition and control apparatus 101 and/or the surface equipment, and the data acquisition and control apparatus 101 may be used to locally control the surface equipment. For example, various control routine updates may be the output of optimization models driven by business intelligence.

In some implementations, the system 100 may be compact, easy-to-install monitoring and control system that may be coupled (wirelessly or wired) with non-invasive and minimally invasive sensors (such as the sensors 121-124) and control devices (such as the control devices 131-134) that can be installed on new or legacy surface equipment (such as surface equipment 110 and 111). In some implementations, the system may have a "plug-n-play" configurable approach to adding sensors and control devices to automatically map and configure the sensors and control devices, which may allow the addition of various sensor types on an as-needed basis. The sensors and control devices also may be manually mapped and configured. Furthermore, control and automation capabilities can be added remotely (such as via the data acquisition and control apparatus 101 or both the data acquisition and control apparatus 101 and the remote cloud network 150) on an as-needed basis. In some implementations, the data acquisition and control apparatus 101 may have an intuitive configuration interface, and the data acquisition and control apparatus 101, sensors, and control devices may be easy to set up, take down, and move to a different location or to a different surface equipment at the same location. The data acquisition and control apparatus 101 may be able to monitor, control, and automate multiple surface equipment simultaneously (such as surface equipment 110 and 111).

In some implementations, the sensors and control devices may be temporarily installed on legacy surface equipment to perform digitization, analysis, and control on legacy surface equipment. In some implementations, the sensors and control devices may be temporarily installed on legacy surface equipment as a precursor to automation. Performing the monitoring, digitization, and analysis may provide detailed information on how the legacy surface equipment operates, which may help to develop the automation for the modern and digital equivalent of the legacy surface equipment. For example, the data analysis may show how long it takes pressure to equalize when you control a valve, or how long does the valve take to close, the sequence and timing of when two or more valves open and close, or the time it takes to reach a certain temperature near a valve, etc. In addition to automation, the derived measurements and analytics may help improve the operation and processes of the surface equipment and perform troubleshooting. The data acquisition and control apparatus 101 and the remote cloud network 150 may allow operators to manage the data, measurements and other analytics, and generate reports, simulations, and other outputs that can show the automation plans, troubleshooting plans, and plans for improving the operation of the surface equipment. In some implementations, the one or more sensors and the one or more control devices of the system 100 may be configurable and movable from one surface equipment to the other (such as from the surface equipment 110 to the surface equipment 111) to monitor and analyze sensor data and perform other analytics in various surface equipment systems. For example, one or more sensors (such as the sensors 121 and 122) and one or more control devices (such as the control devices 131 and 132) may be temporarily installed in a first surface equipment (such as the surface equipment 110) for monitoring, analysis, and control. The one or more sensors and one or more control devices may be removed from the first surface equipment after completing the monitoring, analysis, and control. The one or more sensors (such as the sensors 121 and 122) and one or more control devices (such as the control devices 131 and 132) may then be moved to a second (different) surface equipment (such as the surface equipment 111) and may be temporarily installed in the second surface equipment for monitoring, analysis, and control. The one or more sensors and one or more control devices may be removed from the second surface equipment after completing the monitoring, analysis, and control. After obtaining the sensor data from two or more surface equipment, the data acquisition and control apparatus 101 may manage the data, measurements and other analytics, and generate reports, simulations, and other outputs that can show automation plans, troubleshooting plans, and plans for improving the operation of the surface equipment.

Figure 2:
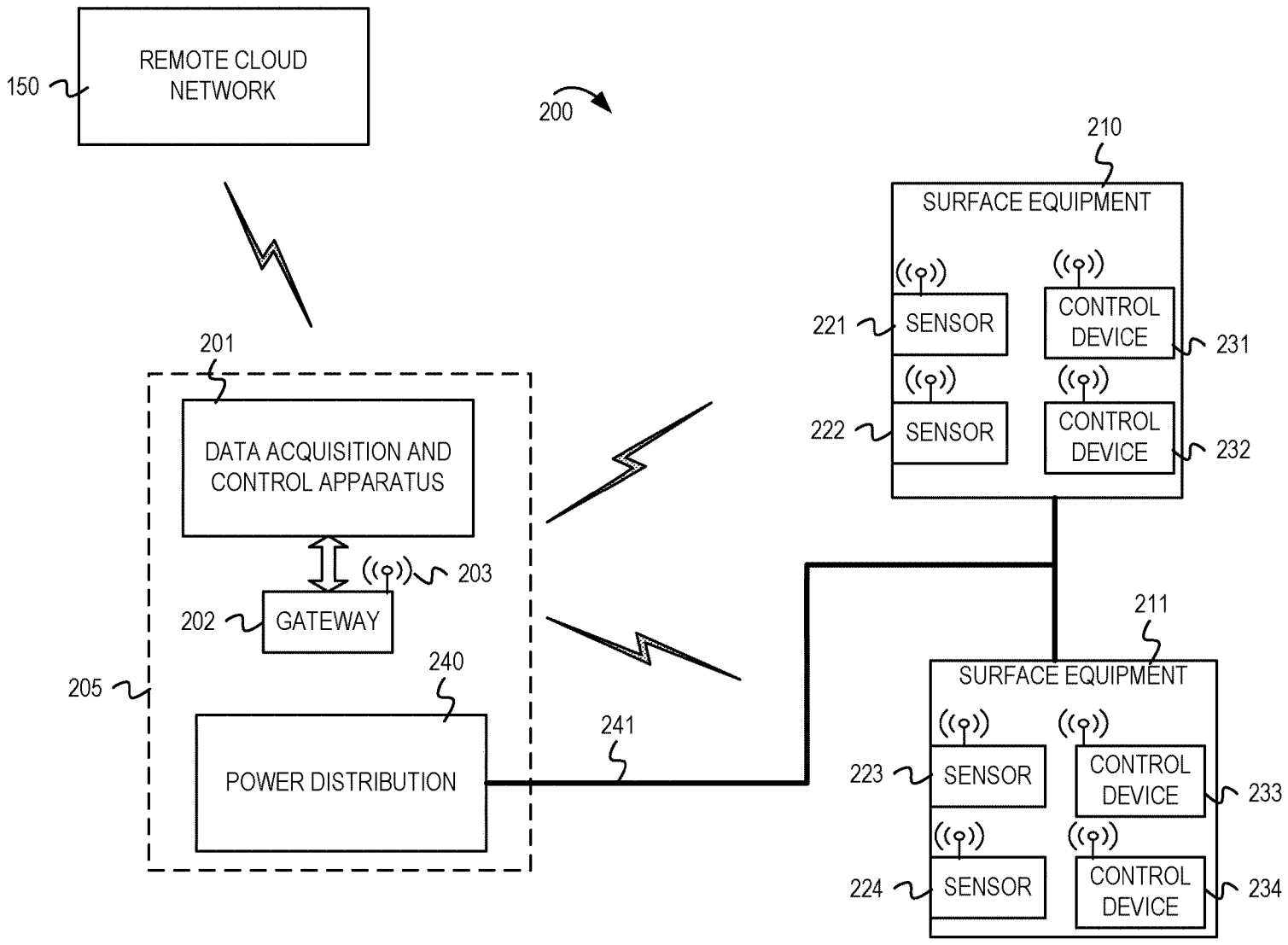
FIG. 2 depicts an example system configured to monitor and control surface equipment and provide power distribution to the surface equipment.

FIG. 2 depicts an example system 200 configured to monitor and control surface equipment and provide power distribution to the surface equipment. In some implementations, the system 200 may be configured to monitor and control surface equipment used in industrial services, such as the oil services industry, and provide power distribution to the surface equipment. In some implementations, the system 200 may include a modular container 205 that includes a data acquisition and control apparatus 201 and a power distribution unit 240. The system 200 also may include one or more sensors, and one or more control devices. For example, the system 200 may include sensors 221-224 and control devices 231-234. The data acquisition and control apparatus 201 also may include a gateway 202 and an antenna 203 for receiving sensor data from the sensors 221-224 and for transmitting control information to the control devices 231-234. In some implementations, the power distribution unit 240 may include transformers, an uninterruptable power supply (UPS), cable reels, and cable connectors, among others, all housed together as a singular modular unit, along with the data acquisition and control apparatus 201. In some implementations, a source of power may be accessed that is separate from the power distribution 240. For example, the source of power may be one or more of solar panels, wind turbines, geothermal, wave generation, diesel engines, fuel cells or other batteries, natural gas, power from a rig, and wireless power, among others. The power distribution unit 240 may connect to the surface equipment 210 and 211 via power cables 241. Similar to the description of FIG. 1, the data acquisition and control apparatus 201 may be portable and movable from one location to another. The one or more sensors may be temporarily or permanently installed in new or legacy surface equipment to collect sensor data from the surface equipment. The one or more control devices may be temporarily or permanently installed in new or legacy surface equipment to control at least some of the operation of the surface equipment. For example, the sensor 221, the sensor 222, the control device 231, and the control device 232 may be installed in the surface equipment 210, and the sensor 223, the sensor 224, the control device 233, and the control device 234 may be installed in the surface equipment 211. The various types of the sensors 221-224, the control devices 231-234, the data acquisition and control apparatus 201, the surface equipment 210 and 211, and the remote cloud network 150 may be the same as described with reference to FIG. 1.

In some implementations, the operations of the sensors 221-224, the control devices 231-234, the data acquisition and control apparatus 201, and the remote cloud network 150 may be the same or similar as described with reference to FIG. 1. For example, as described in FIG. 1, the data acquisition and control apparatus 201 may monitor and analyze sensor data received from the sensors and determine control information that can be transmitted to the control devices in the surface equipment to control one or more operations of the surface equipment. As one example, the surface equipment 210 may be a transfer pump and a sensor (such as sensor 221) may measure pressure, and the surface equipment 211 may be a choke and a sensor (such as sensor 223) may measure flow rate or temperature. Also, a control device (such as control device 231) of the surface equipment 210 may be an actuator or motor that turns a valve of the transfer pump, and a control device (such as control device 233) may be an actuator or motor that turns a valve (or an actuator that turns on or off a switch or button) to control the flow through the choke. In some implementations, the data acquisition and control apparatus 201 may perform analytics, modeling, visualization, and other processing in order to improve the monitoring, control, automation, and updates of the system 200. In some implementations, the data acquisition and control apparatus 201 may work in conjunction with the remote cloud network 150 to perform analytics, modeling, visualization, and other processing in order to improve the monitoring, control, automation, and updates of the system 200.

Furthermore, in some implementations, the system 200 may distribute power to two or more surface equipment systems, such as surface equipment 210 and 211. For example, the system 200 may distribute power to surface equipment that uses high power amounts to facilitate actuation of various control devices, such as valves, controllers, or instruments. In some implementations, the modular container 205 may be a safety rated cabin or container with a fixed installation and vibration isolation protection. This type of cabin or container may lead to electrical components (such as the data acquisition and control apparatus 201, the gateway 202, etc.) ratings and enclosure requirements and specifications that are significantly reduced, which may minimize cost and accelerate the configuration and installation (such as the "plug-and-play" or configurable features of the components) of the system 200 in temporary locations and the movement of the system 200 to different locations. Although FIG. 2 shows a system 200 configured to monitor and control surface equipment and provide power distribution to the surface equipment, the system 200 may be used for various other applications involving various types of surface equipment, such as the system 300 described in FIG. 3.

Figure 3:
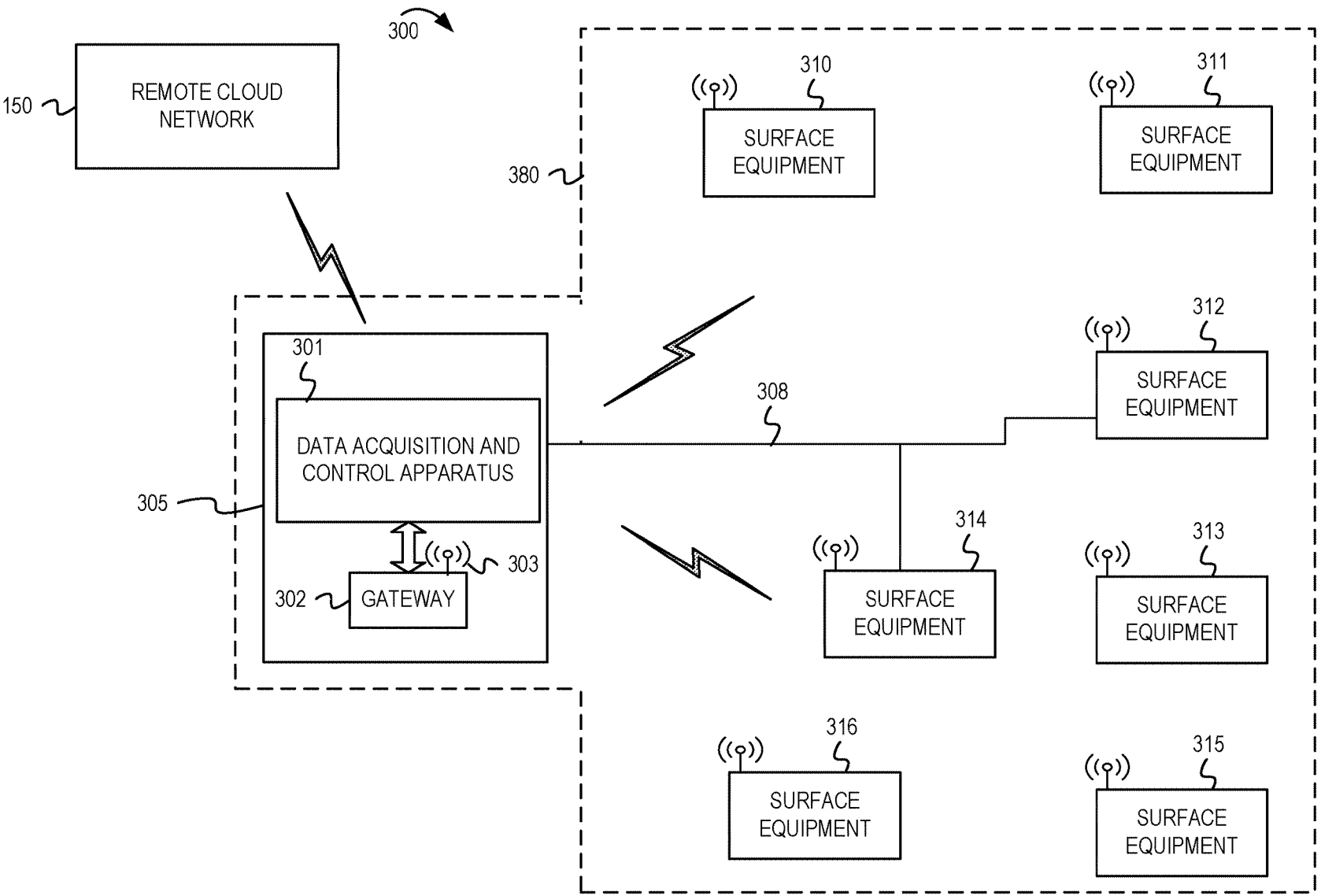
FIG. 3 depicts an example system configured to monitor and control various types of surface equipment.

FIG. 3 depicts an example system 300 configured to monitor and control various types of surface equipment. In some implementations, the system 300 may be configured to monitor and control surface equipment used in industrial services, such as the oil services industry. Although not shown in FIG. 3, the system 300 also may provide power distribution to the various types of surface equipment (as described in FIG. 2). In some implementations, the surface equipment may be located at an industrial site 380 (permanent or temporary), such as in a plant, a refinery, a factory, or other types of industrial sites (such as an oil services site). The surface equipment may include various separate surface equipment systems, such as surface equipment 310, surface equipment 311, surface equipment 312, surface equipment 313, surface equipment 314, surface equipment 315, and surface equipment 316, among others. The surface equipment 310-316 may be any time of new or legacy surface equipment, such as surge tanks, transfer pumps, separators, multi-phase flow meters, steam heat exchangers, air compressors, choke manifolds, chemical injection pumps, solids collection systems, sand management systems, power generation systems, power distribution systems, pump trucks, water tanks, construction equipment, farm equipment, coiled tubing units, wireline or slickline units, drilling units, hydraulic workovers, mining equipment, transport ships and dock units, chemical processing units, and distribution centers, among others. The surface equipment may be temporarily or permanently located at the site.

In some implementations, the system 300 may further include site monitoring and control center 305 that includes at least a data acquisition and control apparatus 301, one or more gateways (such as gateway 302), and one or more antennas (such as antenna 303). The system 300 may further include one or more sensors at each surface equipment 310-316, and one or more control devices at each surface equipment 310-316. In some implementations, the data acquisition and control apparatus 301 may wirelessly communicate (such as via sensor wireless communication or wireless LAN) with the sensors and control devices. In some implementations, the data acquisition and control apparatus may communicate with one or more of the surface equipment 310-316 via a wired LAN connection 308 (such as Ethernet). In some implementations, site control center 305 also may include a power distribution unit (not shown) for distributing power to the surface equipment 310-316, as described in FIG. 2. Similar to the description of FIG. 1, the data acquisition and control apparatus 301 may be portable and movable from one location to another. The one or more sensors may be temporarily or permanently installed in new or legacy surface equipment to collect sensor data from the surface equipment. The one or more control devices may be temporarily or permanently installed in new or legacy surface equipment to control at least some of the operation of the surface equipment.

In some implementations, the operations of the sensors, the control devices, the data acquisition and control apparatus 301, and the remote cloud network 150 may be the same or similar as described with reference to FIG. 1. For example, as described in FIG. 1, the data acquisition and control apparatus 301 may monitor and analyze sensor data received from the sensors and determine control information that can be transmitted to the control devices in the surface equipment to control one or more operations of the surface equipment. As another example, the data acquisition and control apparatus 301 may perform analytics, modeling, visualization, and other processing in order to improve the monitoring, control, automation, and updates of the system 300. As another example, the data acquisition and control apparatus 301 may work in conjunction with the remote cloud network 150 to perform analytics, modeling, visualization, and other processing to improve the monitoring, control, automation, and updates of the system 300.

Example Operations

Figure 4:
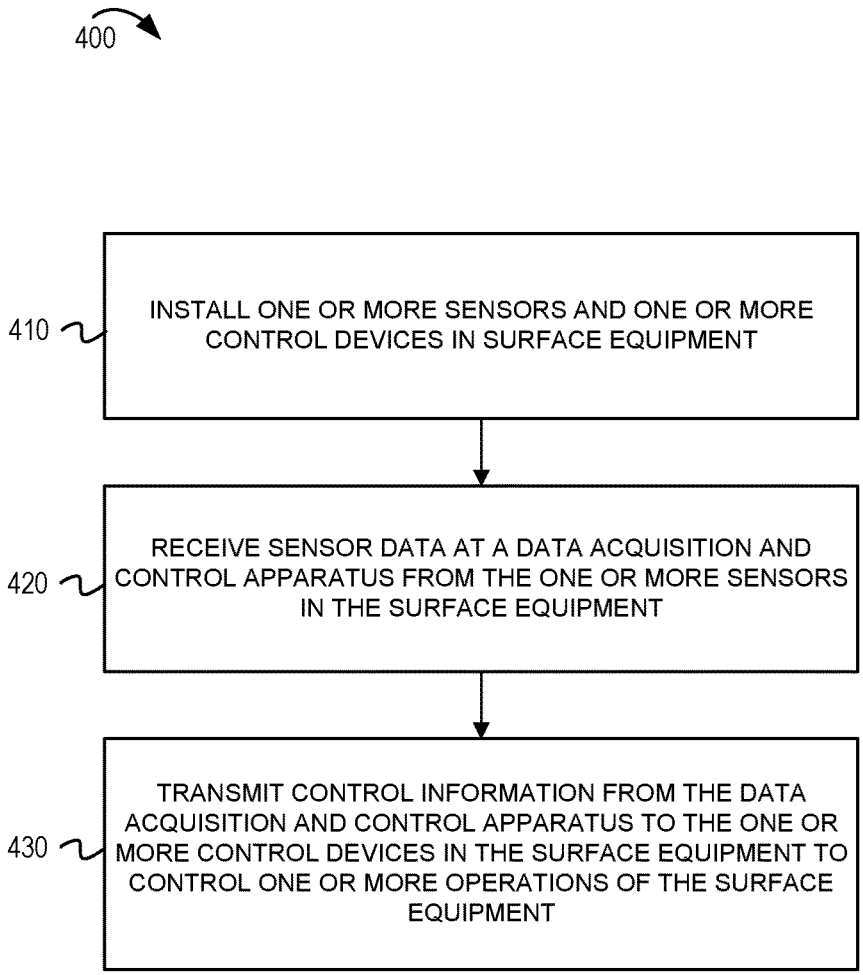
FIG. 4 is a flowchart of example operations for monitoring and controlling surface equipment.

FIG. 4 is a flowchart of example operations for monitoring and controlling surface equipment. The operations may include installing one or more sensors and one or more control devices in the surface equipment (block 410). The operations may include receiving sensor data at a data acquisition and control apparatus from the one or more sensors in the surface equipment (block 420). The operations may include transmitting control information from the data acquisition and control apparatus to the one or more control devices in the surface equipment to control one or more operations of the surface equipment (block 430).

In some implementations, the operations may further include configuring the one or more sensors and the one or more control devices for operation in the new or legacy surface equipment. In some implementations, the operations may further include receiving, at the data acquisition and control apparatus, first sensor data from at least one sensor installed in a first surface equipment, and second sensor data from at least one sensor installed in a second surface equipment. The operations may further include transmitting, from the data acquisition and control apparatus, first control information to at least one control device installed in the first surface equipment and second control information to at least one control device installed in the second surface equipment.

In some implementations, the operations may further include temporarily installing the one or more sensors and the one or more control devices in the surface equipment for monitoring and analysis, and also include removing the one or more sensors and the one or more control devices from the surface equipment after the monitoring and analysis. In some implementations, the operations may further include temporarily installing the one or more sensors and the one or more control devices in a first surface equipment for monitoring and analysis, removing the one or more sensors and the one or more control devices from the first surface equipment after the monitoring and analysis, temporarily installing the one or more sensors and the one or more control devices in the second surface equipment for monitoring and analysis, and removing the one or more sensors and the one or more control devices from the second surface equipment after the monitoring and analysis.

Example Computer

Figure 5:
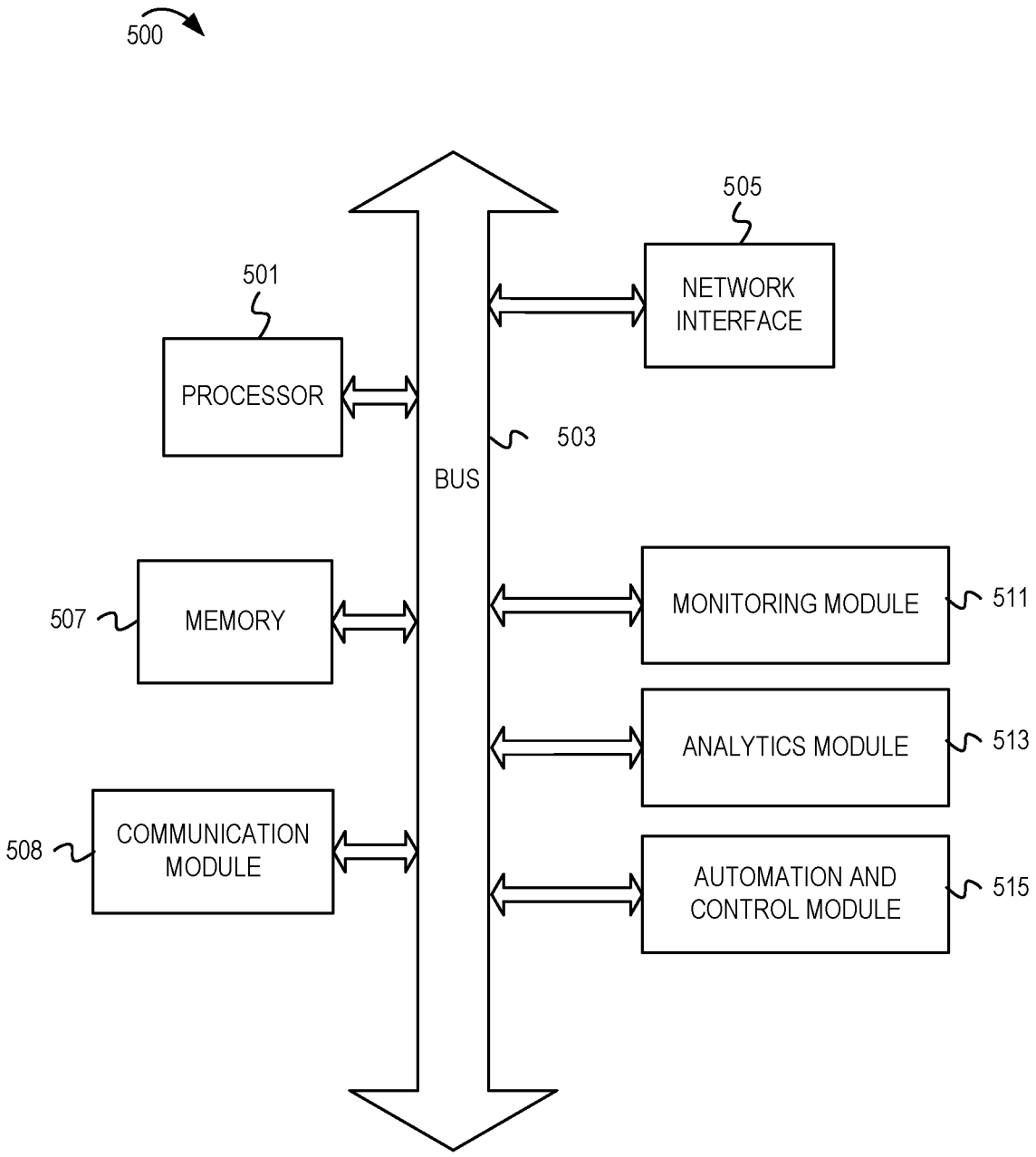
FIG. 5 depicts an example computer system configured to monitor and control surface equipment.

FIG. 5 depicts an example computer system configured to monitor and control surface equipment. The computer system 500 may be an example of the data acquisition and control apparatus shown in FIGS. 1-3. The computer system 500 also may be an example of one or more services in the remote cloud network shown in FIGS. 1-3. The computer system 500 may include one or more processor units 501 (possibly including multiple cores, multiple nodes, and/or implementing multi-threading, etc.). The computer system 500 may include memory 507. The memory 507 may be system memory or any one or more of the above already described possible implementations of machine-readable media. The computer system 500 also may include a bus 503 and a network interface 505. The computer system 500 also may include a communications module 508 that may control wired and wireless communications, such as receiving sensor data from sensors installed in surface equipment, transmitting the received sensor data to the remote cloud network, and transmitting control information to control devices installed at surface equipment, as described with reference to FIGS. 1-3. The computer system 500 also may include at least a monitoring module 511, an analytics module 513, and an automation module, among other processing modules that perform operations described in FIGS. 1-4. For example, the monitoring module 511 may manage and process sensor data from sensors installed in surface equipment, as described in FIGS. 1-4. The analytics module 513 may analyze the sensor data, perform modeling and visualization of the sensor data, and provide various other analytics information, as described in FIGS. 1-4. The automation module 515 may perform automation and control functions based on the analytics information, historical information, and other derived information, as described in FIGS. 1-4. The functionality described herein may be implemented with an application-specific integrated circuit, in logic implemented in the processor unit 501, in a co-processor on a peripheral device or card, etc. Further, implementations may include fewer or additional components not illustrated in FIG. 5 (e.g., video cards, audio cards, additional network interfaces, peripheral devices, etc.). The processor unit 501 and the network interface 505 may be coupled to the bus 503. Although illustrated as being coupled to the bus 503, the memory 507 may be coupled to the processor unit 501.

Example Wellbore Applications

Figure 6:
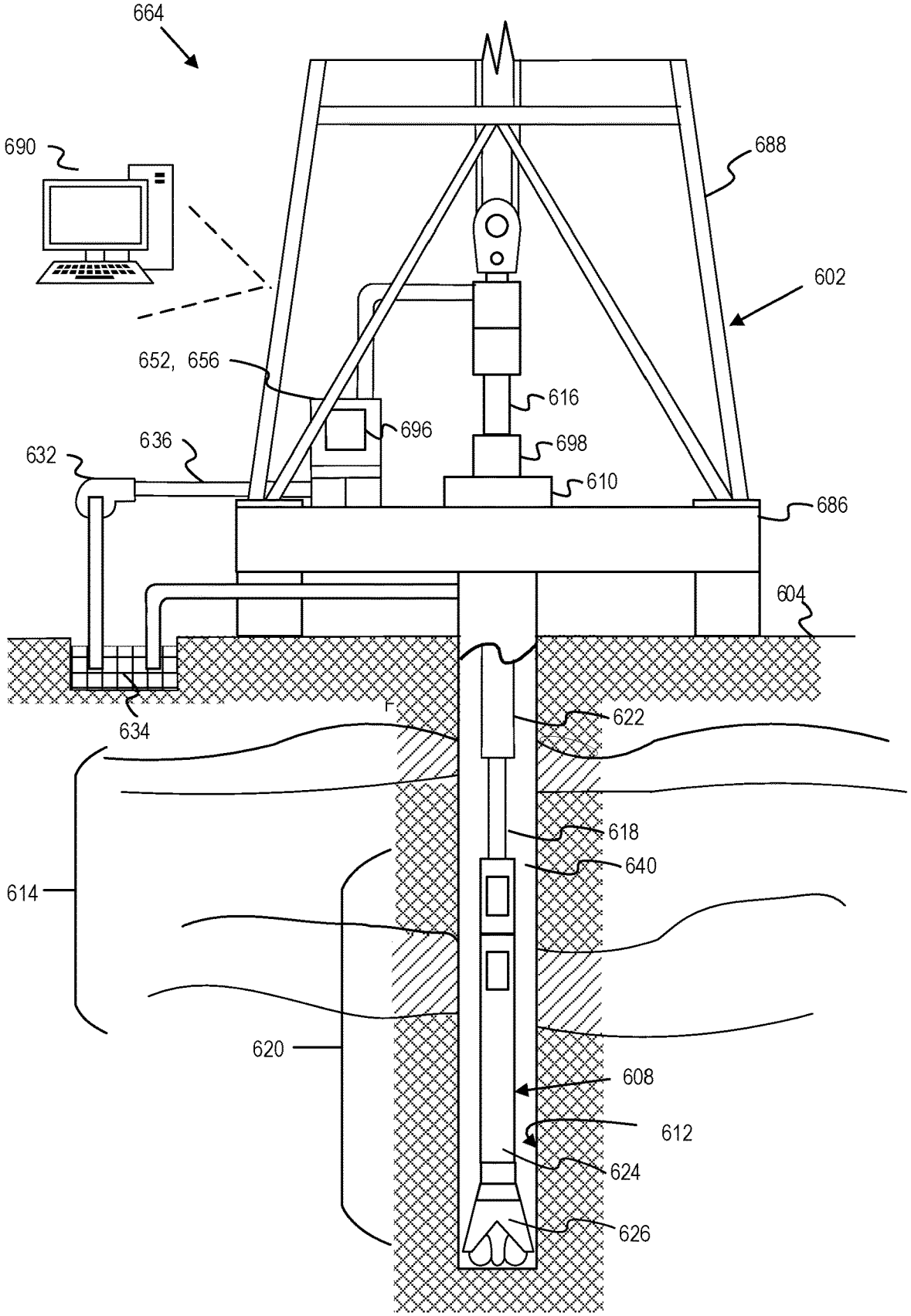
FIG. 6 is a schematic diagram of a drilling rig system, as an example of oil services systems that use surface equipment.

FIG. 6 is a schematic diagram of a drilling rig system, as an example of oil services systems that use surface equipment. For example, in FIG. 6 it can be seen how a system 664 may also form a portion of a drilling rig 602 located at the surface 604 of a well. Drilling of oil and gas wells is commonly carried out using a string of drill pipes connected together so as to form a drilling string 608 that may be lowered through a rotary table 610 into a wellbore or borehole 612. Here a drilling platform 686 may be equipped with a derrick 688 that supports a hoist. A computer system 690 (e.g., similar to the computer system 500) may be communicatively coupled to any sensors and control devices attached to surface equipment of the system 664, as described herein.

The drilling rig 602 may thus provide support for the drill string 608. The drill string 608 may operate to penetrate the rotary table 610 for drilling the borehole 612 through subsurface formations 614. The drill string 608 may include a Kelly 616, drill pipe 618, and a bottom hole assembly 620, perhaps located at the lower portion of the drill pipe 618.

The bottom hole assembly 620 may include drill collars 622, a down hole tool 624, and a drill bit 626. The drill bit 626 may operate to create a borehole 612 by penetrating the surface 604 and subsurface formations 614. The down hole tool 624 may comprise any of a number of different types of tools including MWD tools, LWD tools, and others.

During drilling operations, the drill string 608 (perhaps including the Kelly 616, the drill pipe 618, and the bottom hole assembly 620) may be rotated by the rotary table 610. In addition to, or alternatively, the bottom hole assembly 620 may also be rotated by a motor (e.g., a mud motor) that may be located down hole. The drill collars 622 may be used to add weight to the drill bit 626. The drill collars 622 may also operate to stiffen the bottom hole assembly 620, allowing the bottom hole assembly 620 to transfer the added weight to the drill bit 626, and in turn, to assist the drill bit 626 in penetrating the surface 604 and subsurface formations 614.

Drilling operations may utilize various surface equipment, such as a mud pump 632 or other types of surface equipment. The surface equipment may be outfitted with one or more sensors and one or more control devices, as described herein. During drilling operations, the mud pump 632 may pump drilling fluid (sometimes known by those of ordinary skill in the art as "drilling mud") from a mud pit 634 through a hose 636 into the drill pipe 618 and down to the drill bit 626. In some implementations, one or more sensors may monitor one or more metrics of the pump drilling fluid (such as flow rate), and one or more control devices may control one or more operations of the mud pump 632 (such as opening and closing one or more valves or other mechanisms). The drilling fluid may flow out from the drill bit 626 and be returned to the surface 604 through an annular area 640 between the drill pipe 618 and the sides of the borehole 612. The drilling fluid may then be returned to the mud pit 634, where such fluid may be filtered. In some embodiments, the drilling fluid may be used to cool the drill bit 626, as well as to provide lubrication for the drill bit 626 during drilling operations. Additionally, the drilling fluid may be used to remove subsurface formation 614 cuttings created by operating the drill bit 626. It may be the images of these cuttings that many implementations operate to acquire and process.

Figure 7:
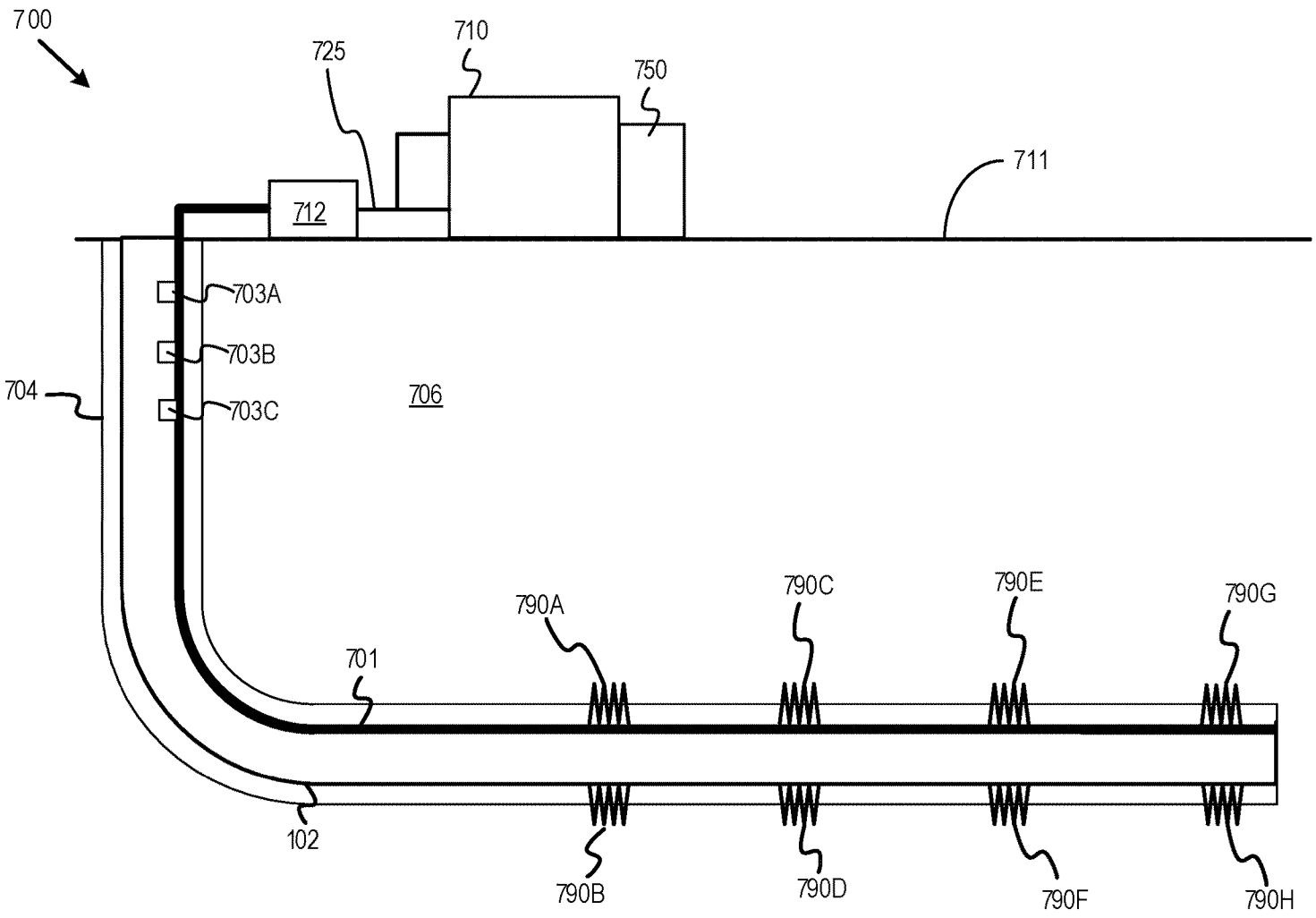
FIG. 7 is a schematic diagram of an example well system that includes fracturing operations, according to some embodiments.

FIG. 7 is a schematic diagram of an example well system that includes fracturing operations, according to some embodiments. A well system 700 may comprise a wellbore 704 in a subsurface formation 706. The wellbore 704 may include a casing 702 and a number of perforations 790A-790G being made in the casing 702 at different depths as part of hydraulic fracturing to allow hydraulic communication between the subsurface formation 706 and the casing 702. The well system 700 also may include a fiber optic cable 701. The fiber optic cable 701 may be cemented in place in the annular space between the casing 702 of the wellbore 704 and the subsurface formation 706. In some implementations, the fiber optic cable 701 may be clamped to the outside of the casing 702 during deployment and protected by centralizers and cross coupling clamps. The fiber optic cable 701 may house one or more optical fibers, and the optical fibers may be single mode fibers, multi-mode fibers, or a combination of single mode and multi-mode optical fibers.

The fiber optic cable 701 may be used for distributed sensing where acoustic, strain, and temperature data may be collected. The data may be collected at various positions distributed along the fiber optic cable 701. For example, data may be collected every 1-3 ft along the full length of the fiber optic cable 701. The fiber optic cable 701 may be included with coiled tubing, wireline, loose fiber using coiled tubing, or gravity deployed fiber coils that unwind the fiber as the coils are moved in the wellbore 704. The fiber optic cable 701 also may be deployed with pumped down coils and/or self-propelled containers. Additional deployment options for the fiber optic cable 701 may include coil tubing and wireline deployed coils where the fiber optic cable 701 is anchored at the toe of the wellbore 704. In such embodiments, the fiber optic cable 701 may be deployed when the wireline or coiled tubing is removed from the wellbore 704. The distribution of sensors shown in FIG. 7 is for example purposes only. Any suitable sensor deployment may be used. For example, the well system 700 may include fiber optic cable deployed sensors or sensors cemented into the casing. Different types of sensors deployments also may be combined in a single well, such as including both sensors cemented to the casing and sensors in plugs, flow metering devices, etc. in a single well system.

A fiber optic interrogation unit 712 may be located on the surface 711 of the well system 700. The fiber optic interrogation unit 712 may be directly coupled to the fiber optic cable 701. Alternatively, the fiber optic interrogation unit 712 may be coupled to a fiber stretcher module, wherein the fiber stretcher module is coupled to the fiber optic cable 701. The fiber optic interrogation unit 712 may receive measurement values taken and/or transmitted along the length of the fiber optic cable 701 such as acoustic, temperature, strain, etc. The fiber optic interrogation unit 712 may be electrically connected to a digitizer to convert optically transmitted measurements into digitized measurements. The well system 700 may contain multiple sensors, such as sensors 703A-C. There may be any suitable number of sensors placed at any suitable location in the wellbore 704. The sensors 703A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 703A-C may be communicatively coupled (not shown) to other components of the well system 700 (e.g., the computer 710, which may be similar to the computer system 500 of FIG. 5). The sensors 703A-C may be cemented to a casing 702.

A computer 710 may receive the electrically transmitted measurements from the fiber optic interrogation unit 712 using a connector 725. The computer 710 may include a signal processor 707 to perform various signal processing operations on signals captured by the fiber optic interrogation unit 712 and/or other components of the well system 700. The computer 710 may have one or more processors and a memory device to analyze the measurements and graphically represent analysis results on the display device 750. An example of the computer 710 is depicted in FIG. 5, which is described above.

The fiber optic interrogation unit 712 may operate using various sensing principles including but not limited to amplitude-based sensing systems like Distributed Temperature Sensing (DTS), DAS, Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and, in particular, coherent Rayleigh scattering. A DSS system may be a strain sensing system using dynamic strain measurements based on interferometric sensors (e.g., sensors 703A-C) or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 712 may measure changes in optical fiber properties between two points in the optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems may be sensitive to temperature and mechanical, as well as acoustically induced, vibrations. The fiber optic interrogation unit 712 may capture DAS data in the time domain. One or more components of the well system 700 may convert the DAS data from the time domain to frequency domain data using Fast Fourier Transforms (FFT) and other transforms. For example, wavelet transforms may also be used to generate different representations of the DAS data. Various frequency ranges may be used for different purposes and where low frequency signal changes may be attributed to formation strain changes or fluid movement and other frequency ranges may be indicative of fluid or gas movement. Various filtering techniques may be applied to generate indicators of events related to measuring the flow of fluid.

In some implementations, DAS measurements along the wellbore 704 may be used as an indication of fluid flow through the casing 702 in the wellbore 704. Vibrations and/or acoustic profiles may be recorded and stacked over time, where a simple approach could correlate total energy or recorded signal strength with known flow rates. For example, the fiber optic interrogation unit 712 may measure energy and/or amplitude in multiple frequency bands where changes in select frequency bands may be associated with oil, water and/or gas thus enabling multiphase production profiling along the wellbore 704.

In some implementations, flow metering devices (not shown) may be positioned in the wellbore 704 at different depths. The flow metering devices may include at least one fluidic oscillator. The fiber optic cable 701 may detect the signals (i.e., vibrations and/or acoustic signals) generated by the fluid as the fluid flows through the fluidic oscillators of the flow metering devices. In some embodiments, the flow metering devices may be placed in an approximately horizontal section of the wellbore so different phases of the fluid flow through different fluidic oscillators within the flow metering devices. In some embodiments, the flow metering devices may be positioned on surface 711. Sensors, such as the fiber optic cable 701 and electrical sensors may also be placed on surface to detect the signals generated by the flow metering devices. Electrical sensors may be point devices co-located with the flow metering devices. Thus, in addition to acoustic signals, the sensors may measure pressure, differential pressure, vibration, temperature, etc. as the fluid flows through the flow metering devices on surface.

Figure 8:
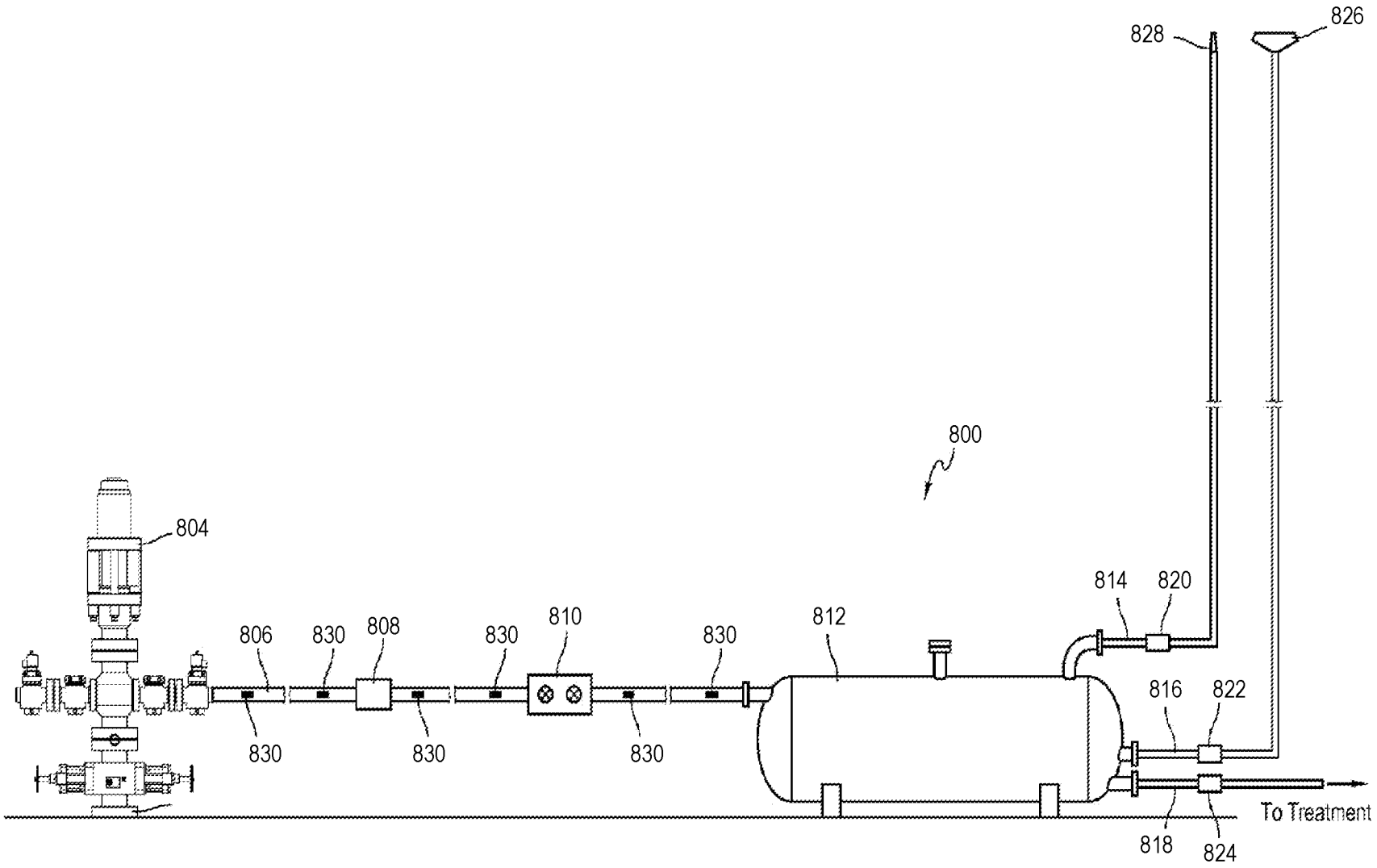
FIG. 8 is a schematic diagram of an example surface well testing facility, according to some embodiments.

FIG. 8 is a schematic diagram of an example surface well testing facility, according to some embodiments. FIG. 8 includes a surface well testing facility 800 includes a wellhead 802 and a surface test tree 804 connected to wellhead 802. The surface test tree 804 includes a plurality of valves for controlling fluid flow into or out of the well. A flow line 806 extends from the surface test tree 804 to transport a multiphase well fluid produced from the well for processing. The flow line 806 may include a heater 808. In addition, the flow line 806 may include a choke manifold 810 which includes one or more valves that are used to accurately throttle the flow from the well so that the fluid pressure downstream from the choke manifold 810 is reduced to a desired pressure.

Downstream from the choke manifold 810 is a separator 812 in which the various constituents of the well fluid are separated. The separator 812 may be a system for handling a three-phase fluid; namely, a fluid having a gas constituent, an oil constituent and a water constituent. The separator 812 may include a gas line 814 discharging from the top of the separator 812, an oil line 816 discharging from an intermediate portion of the separator 812 and a water line 818 discharging near the bottom of the separator 812. An orifice-type gas flow meter 820 may be disposed in the gas line 814. A volumetric oil flow meter 822 may be disposed in the oil line 816. A volumetric water flow meter 824 may disposed in water line 818. The water line 818 may be directed to a tank or other facility in which the water may be treated for later disposal.

The oil constituent in the oil line 816 may be directed to an oil burner 826. In some implementations, the oil burner 826 is positioned at a distal end of a boom. One or more flow control component such as pumps, valves, regulators and the like (not shown), may be positioned in the oil line 816. The gas constituent in the gas line 814 may be directed to a flare 828 through which the gas constituent is flared to the atmosphere. The gas line 816 may include flow control components such as one or more valves, regulators and the like (not shown).

The surface well testing facility may be a temporary facility that is used only during the well testing phase. As such, the tubulars used to transport the formation fluid throughout the facility are commonly assembled, disassembled and reassembled numerous times resulting in the tubular system having a potentially irregular flow path which may tend to get plugged by the dirty fluid that is initially produced in a well testing operation. Use of internal sensors (not visible in FIG. 8) and one or more data acquisition devices makes locating a blockage in the tubular system safer and more efficient. A plurality of data acquisition devices 830 may be positioned in communicative proximity to sensors disposed within the flow line 806. The sensors may be interrogated by the data acquisition devices 830 to obtain data gathered by the sensors. In some implementations, if the flow rate into the separator 812 declines, the various sensors location along the flow line 806 may be interrogated to determine the location of a pressure drop and therefore the blockage in the flow line 806. In some implementations, instead of, or in addition to, having the data acquisition devices 830, a computer system (not shown on FIG. 8; similar to computer system 500 of FIG. 5) may be used to monitor, collect, and analyze the sensor data, as described herein.

While the aspects of the disclosure are described with reference to various implementations and exploitations, it will be understood that these aspects are illustrative and that the scope of the claims is not limited to them. In general, techniques for reservoir modeling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Example Embodiments can Include the Following:

Embodiment #1: A monitoring and control system for surface equipment used in industrial services, comprising: one or more sensors configured to collect sensor data from the surface equipment; one or more control devices configured to control one or more operations of the surface equipment; and a data acquisition and control apparatus coupled with the one or more sensors and the one or more control devices, the data acquisition and control apparatus configured to receive the sensor data from the one or more sensors and transmit control information to the one or more control devices.

Embodiment #2: The monitoring and control system of Embodiment #1, wherein the surface equipment includes two or more separate surface equipment systems.

Embodiment #3: The monitoring and control system of Embodiment #1, wherein: the surface equipment includes at least a first surface equipment and a second surface equipment, the one or more sensors includes at least one sensor installed in the first surface equipment, and at least one sensor installed in the second surface equipment, and the one or more control devices includes at least one control device installed in the first surface equipment and at least one control device installed in the second surface equipment.

Embodiment #4: The monitoring and control system of Embodiments #1-3, wherein the data acquisition and control apparatus is configured to: receive first sensor data from the at least one sensor installed in the first surface equipment; receive second sensor data from the at least one sensor installed in the second surface equipment; transmit first control information to the at least one control device installed in the first surface equipment; and transmit second control information to the at least one control device installed in the second surface equipment.

Embodiment #5: The monitoring and control system of Embodiment #1, wherein the surface equipment is new or legacy surface equipment, wherein the data acquisition and control apparatus is operable to configure the one or more sensors and the one or more control devices for operation in the new or legacy surface equipment.

Embodiment #6: The monitoring and control system of Embodiment #1, wherein the data acquisition and control apparatus is configured to: analyze the sensor data locally and determine the control information based, at least in part, on the sensor data, or transmitting the sensor data to a remote cloud network for monitoring and analysis.

Embodiment #7: The monitoring and control system of Embodiment #1, wherein the data acquisition and control apparatus is configured to digitize and analyze the sensor data for at least one of monitoring, control, and automation of the surface equipment.

Embodiment #8: The monitoring and control system of Embodiment #1, wherein the data acquisition and control apparatus is further configured to: automate sensor data acquisition from the one or more sensors installed in the surface equipment, and automate the one or more operations of the surface equipment using the one or more control devices.

Embodiment #9: The monitoring and control system of Embodiment #1, wherein the data acquisition and control apparatus is configured to: transmit the sensor data received from the one or more sensors to a remote cloud network; and receive, from the remote cloud network, at least one of analytics information associated with the sensor data, control information for the one or more control devices, automation information for the monitoring and control system, and updates for monitoring and control system.

Embodiment #10: The monitoring and control system of Embodiment #1, wherein the one or more sensors are movable and configurable sensors, the one or more control devices are movable and configurable control devices, and the data acquisition and control apparatus is a portable computer system.

Embodiment #11: A method for monitoring and controlling surface equipment used in industrial services, comprising: installing one or more sensors and one or more control devices in the surface equipment; receiving sensor data at a data acquisition and control apparatus from the one or more sensors in the surface equipment; and transmitting control information from the data acquisition and control apparatus to the one or more control devices in the surface equipment to control one or more operations of the surface equipment.

Embodiment #12: The method of Embodiment #11, wherein the surface equipment includes at least a first surface equipment and a second surface equipment, further comprising: receiving, at the data acquisition and control apparatus, first sensor data from at least one sensor installed in the first surface equipment, and second sensor data from at least one sensor installed in the second surface equipment; and transmitting, from the data acquisition and control apparatus, first control information to at least one control device installed in the first surface equipment and second control information to at least one control device installed in the second surface equipment.

Embodiment #13: The method of Embodiment #11, wherein the surface equipment is new or legacy surface equipment, further comprising: configuring the one or more sensors and the one or more control devices for operation in the new or legacy surface equipment.

Embodiment #14: The method of Embodiment #11, wherein the one or more sensors are movable and configurable sensors, the one or more control devices are movable and configurable control devices, and the data acquisition and control apparatus is a portable computer system, further comprising: temporarily installing the one or more sensors and the one or more control devices in the surface equipment for monitoring and analysis; and removing the one or more sensors and the one or more control devices from the surface equipment after the monitoring and analysis.

Embodiment #15: The method of Embodiment #11, wherein the surface equipment includes at least a first surface equipment and a second surface equipment, the one or more sensors are movable and configurable sensors, the one or more control devices are movable and configurable control devices, and the data acquisition and control apparatus is a portable computer system, further comprising: temporarily installing the one or more sensors and the one or more control devices in the first surface equipment for monitoring and analysis; removing the one or more sensors and the one or more control devices from the first surface equipment after the monitoring and analysis; temporarily installing the one or more sensors and the one or more control devices in the second surface equipment for monitoring and analysis; and removing the one or more sensors and the one or more control devices from the second surface equipment after the monitoring and analysis.

Embodiment #16: The method of Embodiment #11, further comprising: analyzing the sensor data locally at the data acquisition and control apparatus and determining the control information based, at least in part, on the sensor data, or transmitting the sensor data from the data acquisition and control apparatus to a remote cloud network for monitoring and analysis.

Embodiment #17: The method of Embodiment #11, further comprising digitizing and analyzing the sensor data for at least one of monitoring, control, and automation of the surface equipment.

Embodiment #18: The method of Embodiment #11, further comprising: transmitting the sensor data received from the one or more sensors to a remote cloud network; and receiving, from the remote cloud network, at least one of analytics information associated with the sensor data, control information for the one or more control devices, automation information for the monitoring and control system, and updates for monitoring and control system.

Embodiment #19: An apparatus for monitoring and controlling surface equipment used in industrial services, comprising: one or more processors; and a computer-readable medium having instructions stored thereon that are executable by the one or more processors, the instructions including: instructions for receiving and processing sensor data from one or more sensors in the surface equipment; instructions for determining control information for one or more control devices in the surface equipment based, at least in part, on the sensor data; and instructions for transmitting the control information to the one or more control devices in the surface equipment to control one or more operations of the surface equipment.

Embodiment #20: The apparatus of Embodiment #19, wherein the surface equipment includes at least a first surface equipment and a second surface equipment, the instructions further including: instructions for receiving and processing first sensor data from at least one sensor installed in the first surface equipment, and second sensor data from at least one sensor installed in the second surface equipment; and instructions for transmitting first control information to at least one control device installed in the first surface equipment and second control information to at least one control device installed in the second surface equipment.

What is claimed is:

1. A monitoring and control system for surface equipment used in industrial services, comprising:

one or more sensors configured to collect sensor data from the surface equipment, wherein the one or more sensors are movable and configurable sensors;

one or more control devices configured to control one or more operations of the surface equipment, wherein the one or more control devices are movable and configurable control devices; and a data acquisition and control apparatus coupled with the one or more sensors and the one or more control devices, the data acquisition and control apparatus configured to:

receive the sensor data from the one or more sensors and automate sensor data acquisition from the one or more sensors, and transmit control information to the one or more control devices and automate the control of the one or more operations of the surface equipment using the one or more control devices.

2. The monitoring and control system of claim 1, wherein the surface equipment includes two or more separate surface equipment systems.

3. The monitoring and control system of claim 1, wherein:

the surface equipment includes at least a first surface equipment and a second surface equipment, the one or more sensors includes at least one sensor installed in the first surface equipment, and at least one sensor installed in the second surface equipment, and the one or more control devices includes at least one control device installed in the first surface equipment and at least one control device installed in the second surface equipment.

4. The monitoring and control system of claim 3, wherein the data acquisition and control apparatus is configured to:

receive first sensor data from the at least one sensor installed in the first surface equipment;

receive second sensor data from the at least one sensor installed in the second surface equipment;

transmit first control information to the at least one control device installed in the first surface equipment; and transmit second control information to the at least one control device installed in the second surface equipment.

5. The monitoring and control system of claim 1, wherein the surface equipment is new or legacy surface equipment, wherein the data acquisition and control apparatus is operable to configure the one or more sensors and the one or more control devices for operation in the new or legacy surface equipment.

6. The monitoring and control system of claim 1, wherein the data acquisition and control apparatus is configured to:

analyze the sensor data locally and determine the control information locally based, at least in part, on the sensor data, and transmit the locally-determined control information to the one or more control devices of the surface equipment to locally control the one or more operations of the surface equipment based on the locally-determined control information using the one or more control devices.

7. The monitoring and control system of claim 1, wherein the data acquisition and control apparatus is configured to digitize and analyze the sensor data for at least one of monitoring, control, and automation of the surface equipment.

8. The monitoring and control system of claim 1, wherein the data acquisition and control apparatus is configured to:

transmit the sensor data received from the one or more sensors to a remote cloud network; and receive, from the remote cloud network, at least one of analytics information associated with the sensor data, control information for the one or more control devices, automation information for the monitoring and control system, and updates for the monitoring and control system.

9. The monitoring and control system of claim 1, wherein the one or more sensors and the one or more control devices are coupled with the surface equipment, the one or more sensors and the one or more control devices are configurable and movable between the surface equipment and one or more additional surface equipment, and the data acquisition and control apparatus is a portable computer system.

10. The monitoring and control system of claim 1, wherein the sensor data includes at least first sensor data and second sensor data and the control information includes at least first control information and second control information, and wherein the data acquisition and control apparatus is configured to:

receive the first sensor data from the one or more sensors after installation of the one or more sensors and the one or more control devices in the surface equipment for monitoring and analysis, determine the first control information based on the first sensor data, and transmit the first control information to the one or more control devices of the surface equipment;

receive the second sensor data from the one or more sensors, determine the second control information based on the second sensor data, and transmit the second control information to the one or more control devices of the surface equipment; and determine automation of the sensor data acquisition and automation of the control of the one or more operations of the surface equipment based, at least in part, on the first sensor data and the second sensor data.

11. The monitoring and control system of claim 1, wherein the surface equipment includes at least a first surface equipment and a second surface equipment and the sensor data includes at least first sensor data and second sensor data, and wherein the data acquisition and control apparatus is configured to:

receive the first sensor data from the one or more sensors after installation of the one or more sensors and the one or more control devices in the first surface equipment for monitoring and analysis;

receive the second sensor data from the one or more sensors after removal of the one or more sensors and the one or more control devices from the first surface equipment and installation of the one or more sensors and the one or more control devices in the second surface equipment for monitoring and analysis; and determine automation of the sensor data acquisition and automation of the control of the one or more operations of the surface equipment based, at least in part, on the first sensor data and the second sensor data.

12. A method for monitoring and controlling surface equipment used in industrial services, comprising:

installing one or more sensors and one or more control devices in the surface equipment, wherein the one or more sensors are movable and configurable sensors and the one or more control devices are movable and configurable control devices;

receiving sensor data at a data acquisition and control apparatus from the one or more sensors in the surface equipment and automating sensor data acquisition from the one or more sensors; and transmitting control information from the data acquisition and control apparatus to the one or more control devices in the surface equipment to control one or more operations of the surface equipment and automate the control of the one or more operations of the surface equipment using the one or more control devices.

13. The method of claim 12, wherein the surface equipment includes at least a first surface equipment and a second surface equipment, further comprising:

receiving, at the data acquisition and control apparatus, first sensor data from at least one sensor installed in the first surface equipment, and second sensor data from at least one sensor installed in the second surface equipment; and transmitting, from the data acquisition and control apparatus, first control information to at least one control device installed in the first surface equipment and second control information to at least one control device installed in the second surface equipment.

14. The method of claim 12, wherein the surface equipment is new or legacy surface equipment, further comprising:

configuring the one or more sensors and the one or more control devices for operation in the new or legacy surface equipment.

15. The method of claim 12, wherein the data acquisition and control apparatus is a portable computer system, further comprising:

temporarily installing the one or more sensors and the one or more control devices in the surface equipment for monitoring and analysis; and removing the one or more sensors and the one or more control devices from the surface equipment after the monitoring and analysis.

16. The method of claim 12, wherein the surface equipment includes at least a first surface equipment and a second surface equipment, and the data acquisition and control apparatus is a portable computer system, further comprising:

temporarily installing the one or more sensors and the one or more control devices in the first surface equipment for monitoring and analysis;

removing the one or more sensors and the one or more control devices from the first surface equipment after the monitoring and analysis;

temporarily installing the one or more sensors and the one or more control devices in the second surface equipment for monitoring and analysis; and removing the one or more sensors and the one or more control devices from the second surface equipment after the monitoring and analysis.

17. The method of claim 12, further comprising:

analyzing the sensor data locally at the data acquisition and control apparatus and determining the control information locally at the data acquisition and control apparatus based, at least in part, on the sensor data, and transmitting the locally-determined control information from the data acquisition and control apparatus to the one or more control devices of the surface equipment to locally control the one or more operations of the surface equipment based on the locally-determined control information using the one or more control devices.

18. The method of claim 12, further comprising digitizing and analyzing the sensor data for at least one of monitoring, control, and automation of the surface equipment.

19. The method of claim 12, wherein the data acquisition and control apparatus, the one or more sensors, and the one or more control devices are part of a monitoring and control system, further comprising:

transmitting the sensor data received from the one or more sensors to a remote cloud network; and receiving, from the remote cloud network, at least one of analytics information associated with the sensor data, control information for the one or more control devices, automation information for the monitoring and control system, and updates for the monitoring and control system.

20. An apparatus for monitoring and controlling surface equipment used in industrial services, comprising:

one or more processors; and a computer-readable medium having instructions stored thereon that are executable by the one or more processors, the instructions including:

instructions for receiving and processing sensor data from one or more sensors in the surface equipment and automating sensor data acquisition from the one or more sensors, wherein the one or more sensors are movable and configurable sensors;

instructions for determining control information for one or more control devices in the surface equipment based, at least in part, on the sensor data, wherein the one or more control devices are movable and configurable control devices; and instructions for transmitting the control information to the one or more control devices in the surface equipment to control one or more operations of the surface equipment and automate the control of the one or more operations of the surface equipment using the one or more control devices.

21. The apparatus of claim 20, wherein the surface equipment includes at least a first surface equipment and a second surface equipment, the instructions further including:

instructions for receiving and processing first sensor data from at least one sensor installed in the first surface equipment, and second sensor data from at least one sensor installed in the second surface equipment; and instructions for transmitting first control information to at least one control device installed in the first surface equipment and second control information to at least one control device installed in the second surface equipment.

* * * * *